United States Patent [19]

Costanzo

[11] Patent Number: 5,045,018

[45] Date of Patent: Sep. 3, 1991

[54] CAMISOLE COMBINED WITH BRASSIERE CUPS

[76] Inventor: Anna M. Costanzo, 6587 Big Creek Pkwy., Parma Heights, Ohio 44130

[21] Appl. No.: 487,931

[22] Filed: Mar. 5, 1990

[51] Int. Cl.[5] ..... A41C 3/08; A41C 3/10; A41C 3/12

[52] U.S. Cl. ..... 450/31; 450/32; 450/54; 450/55; 450/56; 2/73

[58] Field of Search ..... 450/31, 32, 33, 52, 450/53, 54, 55, 56, 57; 2/73, 67, 69, 110

[56] References Cited

U.S. PATENT DOCUMENTS

| | | | |
|---|---|---|---|
| D. 54,932 | 6/1920 | Krauziewicz . | |
| D. 60,445 | 1/1981 | Schreiber et al. . | |
| D. 65,172 | 8/1924 | D'Etreillis . | |
| D. 67,947 | 8/1925 | Davis | 450/31 X |
| 162,869 | 5/1875 | Tallman | 450/57 |
| 195,755 | 10/1877 | Ferris | 450/55 |
| 505,003 | 12/1893 | Rew . | |
| 1,256,203 | 2/1918 | Cook | 450/57 |
| 1,510,388 | 11/1924 | Darling . | |
| 1,566,267 | 12/1925 | Bee | 450/31 |
| 1,990,322 | 2/1935 | Goldberg | 450/31 |
| 2,211,549 | 10/1940 | Semons | 2/73 |
| 2,252,833 | 10/1941 | Cadous | 2/73 |
| 2,253,902 | 9/1941 | Gordon | 2/73 |
| 2,267,505 | 3/1941 | O'Bryan | 2/73 |
| 2,274,382 | 2/1942 | Richman | 2/70 |
| 2,428,175 | 9/1947 | Norton | 450/32 |
| 2,472,606 | 2/1949 | Michaleson | 2/42 |
| 2,558,420 | 5/1951 | D'Amato | 3/73 |
| 2,641,763 | 6/1953 | Schroeder | 450/54 |
| 2,671,218 | 3/1954 | Luhr | 450/32 X |
| 2,863,460 | 12/1958 | Monroe | 450/32 X |
| 3,161,200 | 12/1964 | Brickman | 450/31 |
| 3,297,035 | 1/1967 | Wright | 450/31 |
| 3,606,891 | 12/1971 | Marcario | 128/427 |
| 3,623,487 | 11/1971 | Chiu | 450/56 X |
| 4,100,621 | 7/1978 | Ettipio | 450/32 X |
| 4,271,580 | 6/1981 | King et al. | 450/52 X |
| 4,372,320 | 2/1983 | Silber | 450/31 |
| 4,440,174 | 4/1984 | Cordova | 450/31 |
| 4,564,015 | 1/1986 | Friedman | 450/31 |
| 4,699,144 | 10/1987 | Sherwood | 450/54 |
| 4,770,650 | 9/1988 | Rowell | 450/52 |
| 4,798,557 | 1/1989 | Scott | 450/31 |

FOREIGN PATENT DOCUMENTS

| | | | |
|---|---|---|---|
| 0616522 | 3/1961 | Canada | 450/32 |
| 0411587 | 3/1925 | Fed. Rep. of Germany | 450/32 |
| 1904796 | 8/1970 | Fed. Rep. of Germany | 450/57 |
| 1335838 | 7/1963 | France | 450/33 |
| 1503714 | 12/1967 | France | 450/31 |
| 0363949 | 10/1962 | Switzerland | 450/56 |

*Primary Examiner*—Werner H. Schroeder
*Assistant Examiner*—Jeanette E. Chapman
*Attorney, Agent, or Firm*—Woodling, Krost and Rust

[57] ABSTRACT

The combination of a camisole embodying brassiere cups joined with a separate stretchable strip laterally placed at the base of brassiere cups and body of camisole. In addition, the brassiere cups may contain reinforcement materials of either a flexibly stiff semi sphere and/or under wire joined to the interior lower portion of each cup.

5 Claims, 5 Drawing Sheets

CAMISOLE COMBINED WITH BRASSIERE CUPS

BACKGROUND-FIELD OF INVENTION

This invention relates to ladies' undergarments. more particularly referred to as camisoles and brassiere cups. Specifically, it relates to the combination thereof, to relieve the wearer of undue confinement to the torso and to improve the appearance of the wearer's figure.

Originally, the camisole was invented to wear under and/or over a corset for various reasons. U.S Pat. No. Des. 65,172 to Jeanne D'Etreillis, "Design For A Corset Cover" (1924); and U.S. Pat. No. 54,932 to Rozy Krauziewicz, "Design For A Bodice" (1920). It was for cushioning the corset from the skin, concealing corset lines and ornamentally covering the breast for a better outward appearance.

Thereafter, improvements made to the camisole have been ones of ornamental designs. However, certain improvements of use of the camisole have been U.S. Pat. No. 1,510,388 to Louise Darling, "Garment and Shoulder Strap Therefor" (1924), claiming an adjustable shoulder strap; and U.S Pat. No. 2,274,382 to Sidney Richman, "Woman's Foundation Garment" (1942), disclosing three (3) separate and distinct garments, one of which is the camisole, and which garments can be joined together by the wearer or worn separately.

Accordingly, some women prefer to wear camisoles rather than brassieres for comfort; however, there is no breast support provided, thereby making for a poor appearance. Another way the camisole is used is by wearing it over a brassiere to prevent the brassiere from showing through outer garments. This procedure requires many garments to be worn and a total of four straps to be seen through outer garments, also making for a poor appearance.

Therefore, the use of the camisole has not changed since its intended use for the corset. The present invention not only revolutionizes the camisole but also the entire line of breast supporters.

Sometime in the late 1800s, Mary Jacobs had sewn two handkerchiefs and ribbon together to wear in place of her corset thereby inventing the brassiere. Ms. Jacobs then sold her invention, but later revisions of her basic idea did not keep to the light handkerchief material and the smoothness of ribbon. The materials of camisoles are similar to those certain initial materials used. The sole purpose of the brassiere is to support, lift and shape the breasts. The strapping around the back and pulling straps over the shoulders are unnecessary functions to support the breasts, and cause an uncomfortable binding effect.

Thereafter several hundred patents on brassieres have been filed but these rarely eliminate the binding effect. In recent articles, namely, *Life* Magazine, June 1989 issue, *Red Book,* Aug. 1989 issue, and *The Plain Dealer,* Cleveland, Ohio, Thursday, June 8, 1989 newspaper article, it is written that women are looking for more comfort in breast support: that women like pretty, lacy brassieres; and that they do not want to suffer in them. Every brassiere has a tendency of pulling across the front, sides, and back of the wearer. The brassiere yanks around the torso, smashing and spreading the breasts to the sides and under the arms of the wearer and increasing the width of the torso.

In contrast in a camisole with brassiere cups the breasts are comfortably held in the brassiere cups, are not pulled across the upper torso, and are lifted up and outward directly in front of the wearer. The camisole with brassiere cups brings about an enhanced appearance and utmost comfort.

Long line brassieres, which are basically redesigned corsets, have no bearing on this particular invention, mainly because the camisole with brassiere cups is a loose fitting undergarment in contrast to all long line brassieres. The long line brassiere is also girdlelike in its function of binding and molding the flesh. The one and only comparison between long line brassieres and the camisole with brassiere cups is the purpose of breast support. The objective behind this present invention is to do away with binding and cumbersome methods of supporting the breast in an elegant feminine manner.

Some reasonably close prior art references found are brassiere slips, such as those disclosed in U.S. Pat. No. 2,252,833 to Esther Cadous, "Slip" (1941), claiming among other things, ". . . a pair of side panels of one-way stretch elastic fabric joined at the sides of the slip . . . "; U.S Pat. No. 2,558,420 to Rosaria Sadye D'Amato, "Form-Fitting Bra-Slip" (1951), claiming among other things, ". . . an upper section includes adjoined breasts pockets and a back panel of elastic material . . . a form fitting bodice . . . "; and U.S. Pat. No. 2,211,549 to Miriam M. Semons, "Brassiere-Top Sleeping Garment" (1940), claiming mostly details of the construction of the breast pockets.

Consequently, the above patents are all contrary to the present invention. The camisole with brassiere cups is not form fitting; it is more of a loose fitting garment; and may contain any practicable brassiere cups. There is no need to be bound in cumbersome elastic to perform the objective of breast support. Despite any possible similarity of the above patents, the distinction between the slip and the camisole is commonly accepted among women and department stores.

Another reasonably close prior art reference that should be noted is U.S. Pat. No. Des. 260,445 to H. Scheiber, et al., "Athletic Shirt", (1981). The title "Athletic Shirt" speaks for itself. After review of the cited art in H. Scheiber's patent, the Athletic Shirt is evidently a form fitting bodice, whereas the present invention precludes any such form fitting procedures for support of the breasts. Besides one certainly would not feel formally dressed with an athletic shirt under one's finer clothes.

OBJECTS AND ADVANTAGES OF THE INVENTION

Accordingly, the objects and advantages of my invention are:

(a) To provide a camisole which will produce support, lift, and shape that is directly in front of the wearer with an upward and outward appearance.

(b) To provide a camisole which will feel as comfortable as being braless, yet which will produce support, lift and shape to the breasts.

(c) To provide a camisole which will enhance appearance without needing a plurality of undergarments to create the same appearance.

(d) To provide a camisole which may embody any of various practicable brassiere cups.

(e) To provide a camisole which will be easily assembled and at an economical cost to the manufacturer.

(f) To provide a camisole for younger women so they have an opportunity to develop in comfort and without embarrassment.

Further objects and advantages are to provide a comfortable alternative to the brassiere in the same way that the brassiere was a comfortable alternative to the corset one hundred years ago, and which will wear and last as long as such items. Still further objects and advantages will become apparent from a consideration of the ensuing description and drawings.

DESCRIPTION OF FIGS. 1 to 10

Figure 1:
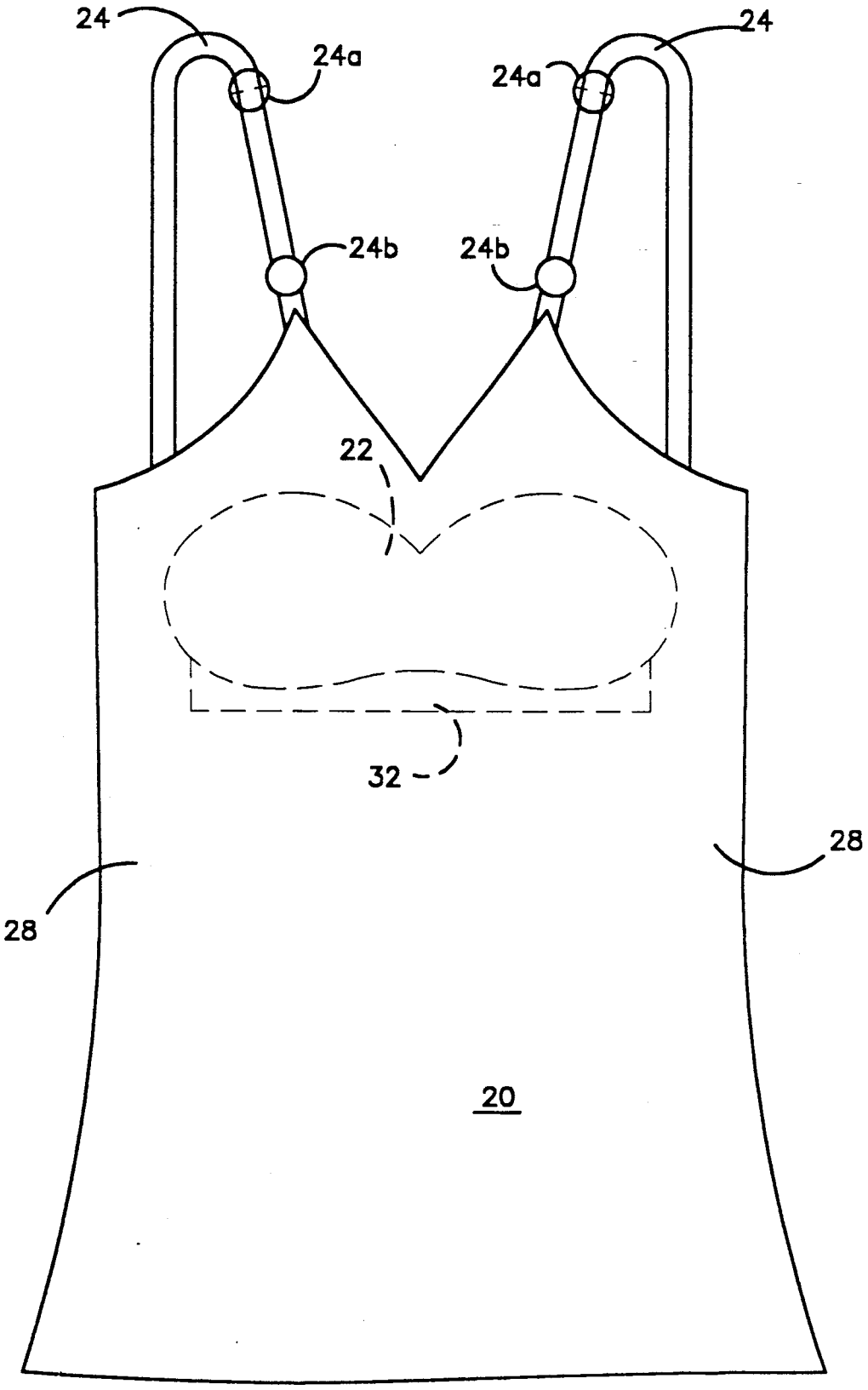
FIG. 1 is a front elevational view of a camisole with embodying brassiere cups with a stretchable strip.
Figure 2:
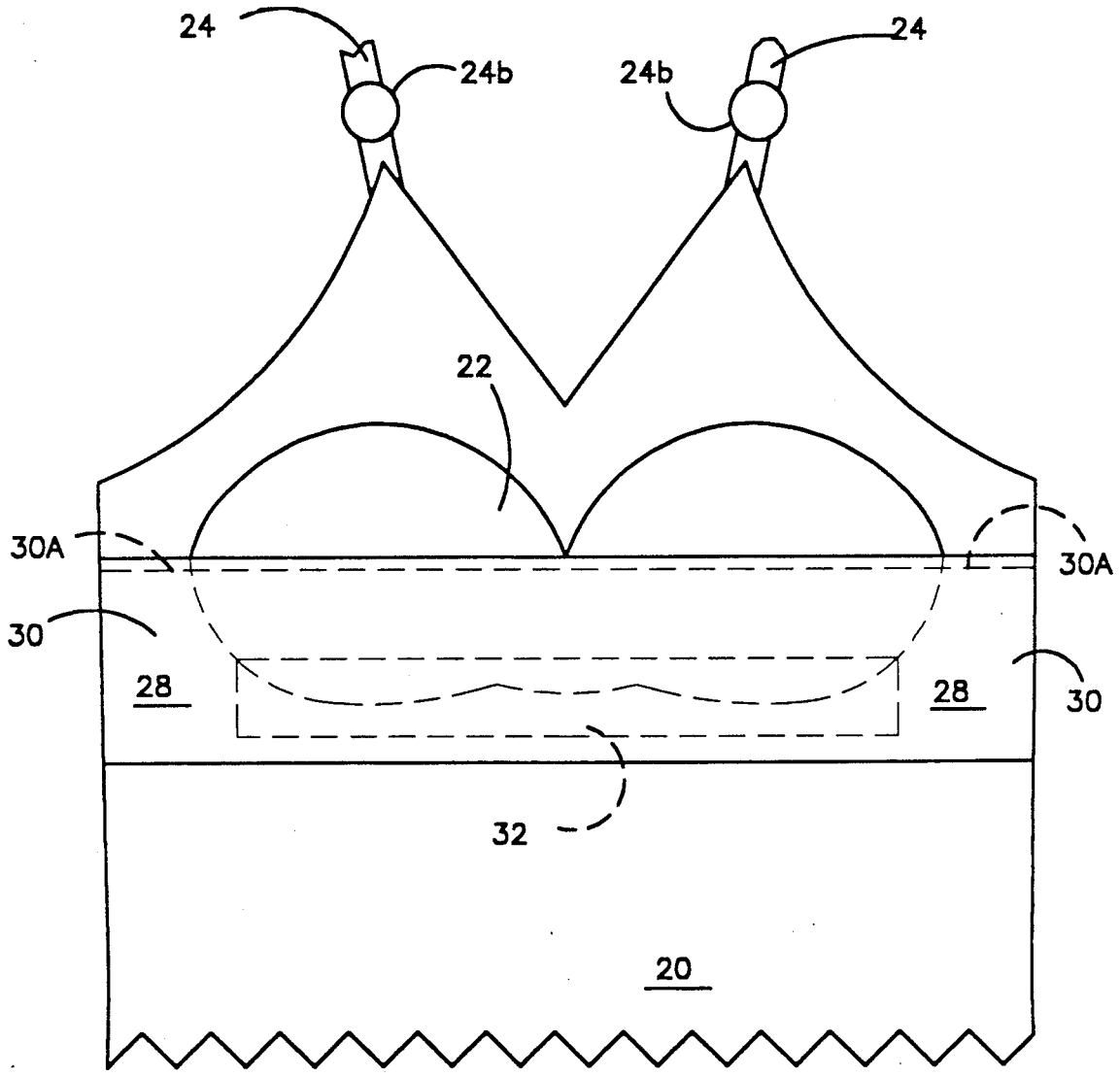
FIG. 2 is a rear elevational view, partly in phantom, of the receiving section of the camisole with brassiere cups, stretchable strip and facing.
Figure 3:
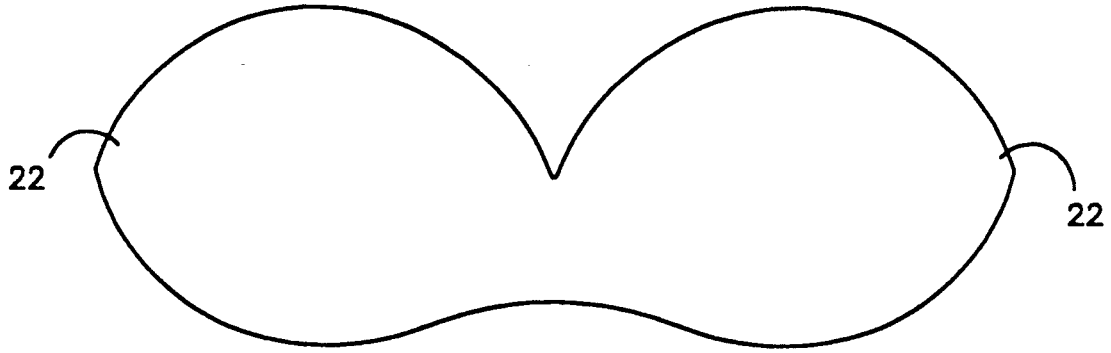
FIGS. 3 to 6 are front elevational views of some alternate embodiments of the present invention.
Figure 4:
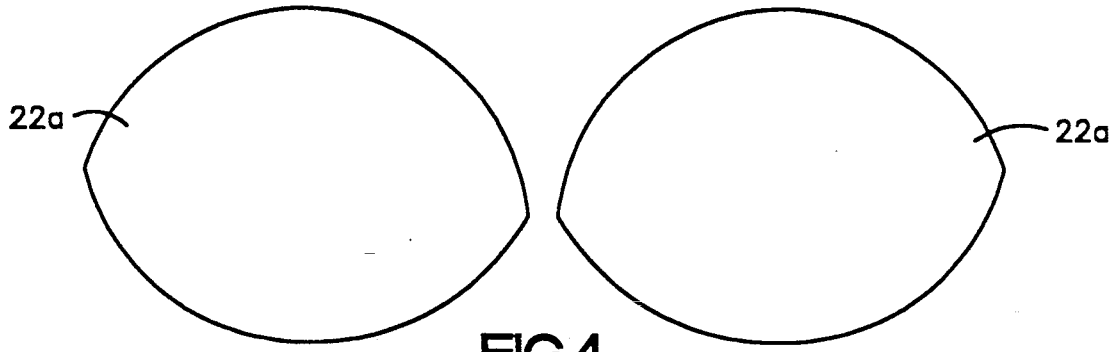
Figure 5:
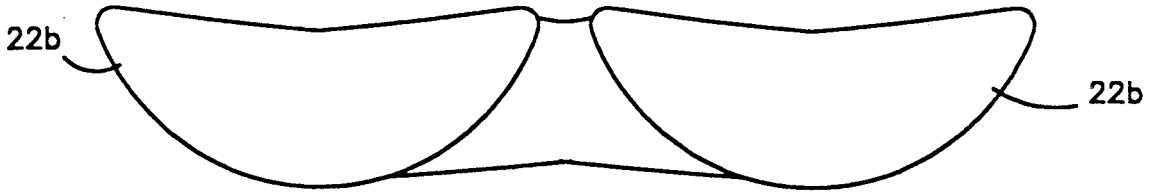
Figure 6:
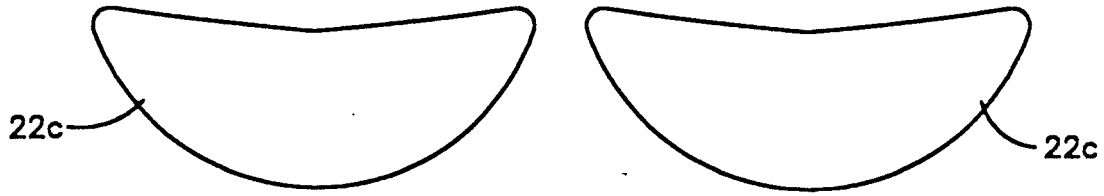
Figure 10:
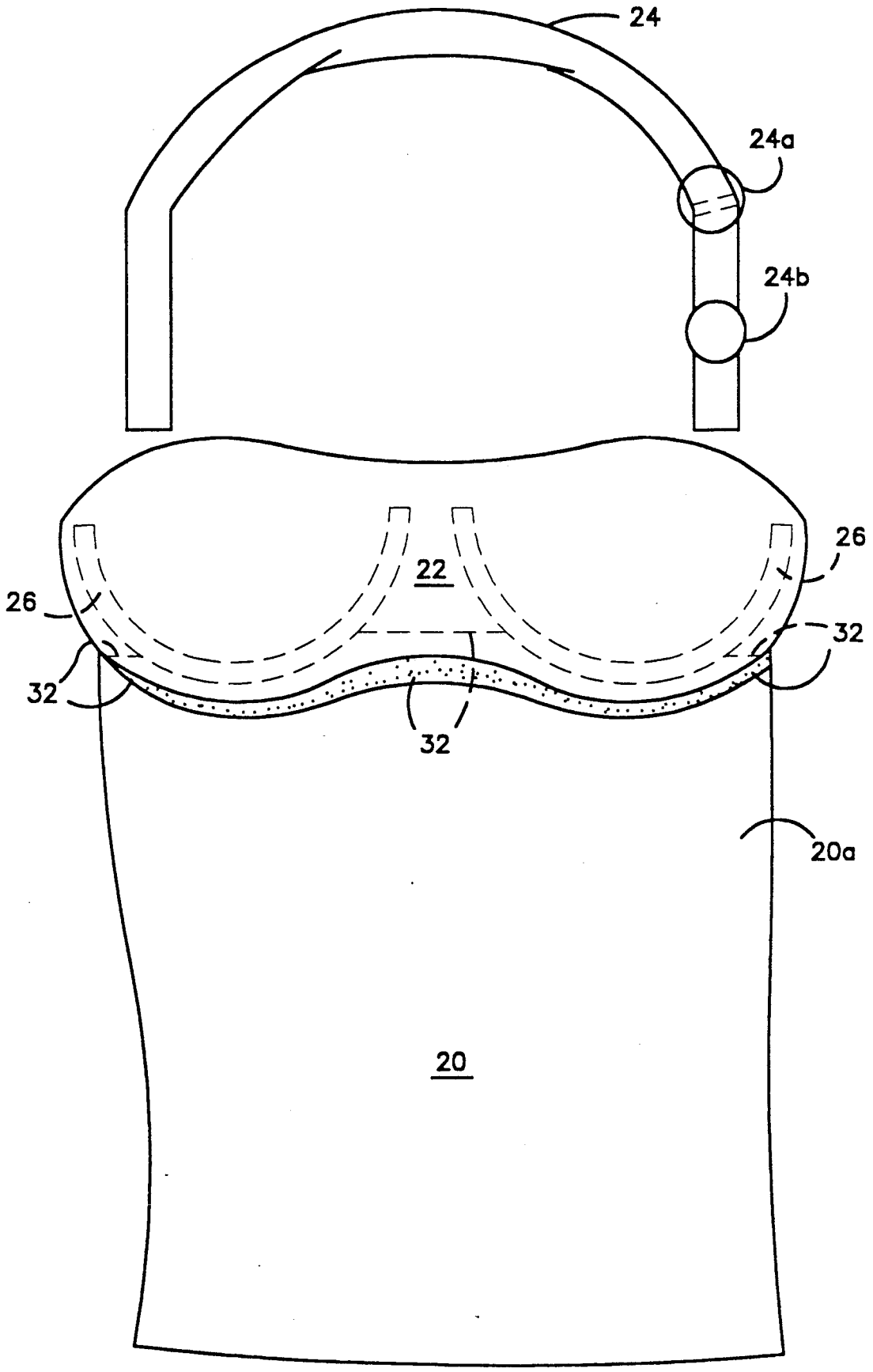
FIG. 10 is a front elevational view of a strapless camisole and a detached front view of an adjustable neck strap.

Referring to FIGS. 1, 2 and 10 of the drawings, three embodiments are shown. 20 designates an improved camisole having a plurality of conventional adjustable shoulder straps 24 each usually connected for over the shoulders and each including a top movable ring type 24A and a lower stationary ring type 24B, the improvement being the embodiment of a pair of brassiere cups 22, and a separate stretchable strip 32 stretched laterally and sewn or otherwise joined to the base and length of brassiere cups 22. Strip 32 may be sewn to the interior receiving section 28 of camisole 20 as indicated in FIGS. 1 and 10. In another embodiment, it may be joined only to cups 22, as shown in FIG. 2.

For the prototype of the present invention, a *Sew-in Bra,* by Dritz$^R$, made of 100% nylon tricot covered latex foam with an elastic strip attached at the base thereof, was used in the embodiment of camisole 20. However, any practicable pair of brassiere cups can be joined to camisole 20 using a separate stretchable strip 32, such as elastic suitably joined to the base and width of brassiere cups 22 and receiving section 28 of camisole 20.

FIG. 2 illustrates the rear view of receiving section 28 with an inside facing 30. Facing 30 is attached in such a way to form a pocket 30A holding brassiere cups 22 with stretchable strip 32. Pocket 30A is attached at its bottom and sides to the camisole to make a pocket to hold the cups 22 and strip 32. The open top of the pocket 30A is hemmed. With pocket 30A to hold cups 22 and strip 32 it will be seen that they may simply be inserted into the pocket to be located in place without being sewn to the camisole.

FIGS. 3, 4, 5 and 6 are illustrations of practicable pairs of brassiere cups 22, indicating linked cups 22, separated cups 22A, linked half cups 22B, and separated half cups 22C, collectively referred to as brassiere cups 22, which are some of the preferred embodiments considered here to be combined with camisole 20.

Figure 7:
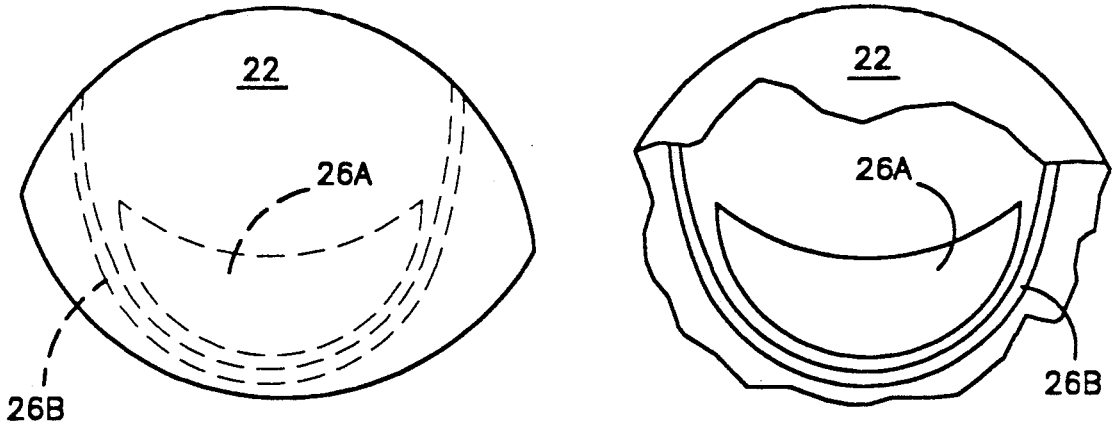
FIGS. 7 to 9 are elevational front views and sectional views of reinforcement materials for brassiere cups.

FIG. 7 illustrates reinforcement materials 26A and B. A semi sphere 26A made of either crinoline or plastic in accordance with natural contours and a conventional under wire 26B both suitably joined to the interior lower portion of each cup.

Figure 8:
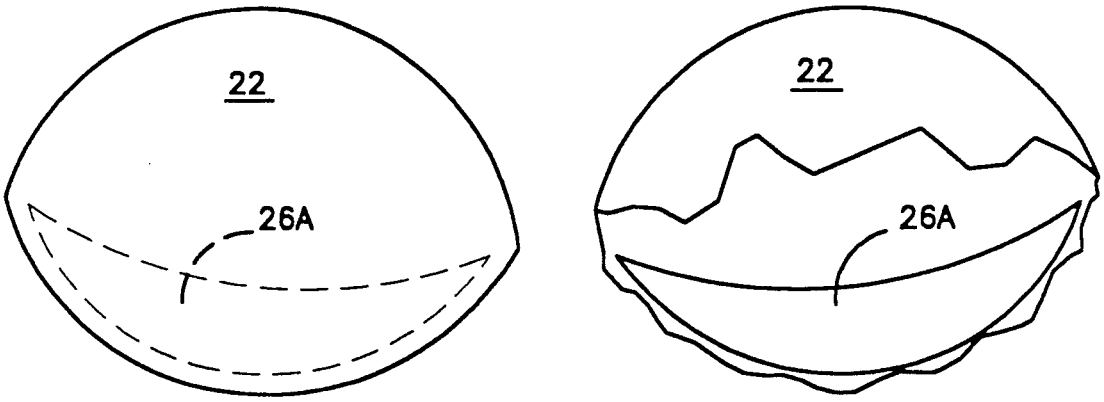

FIG. 8 illustrates reinforcement material semi sphere 26A made of either crinoline or plastic contoured and joined to the interior lower portion of each cup.

Figure 9:
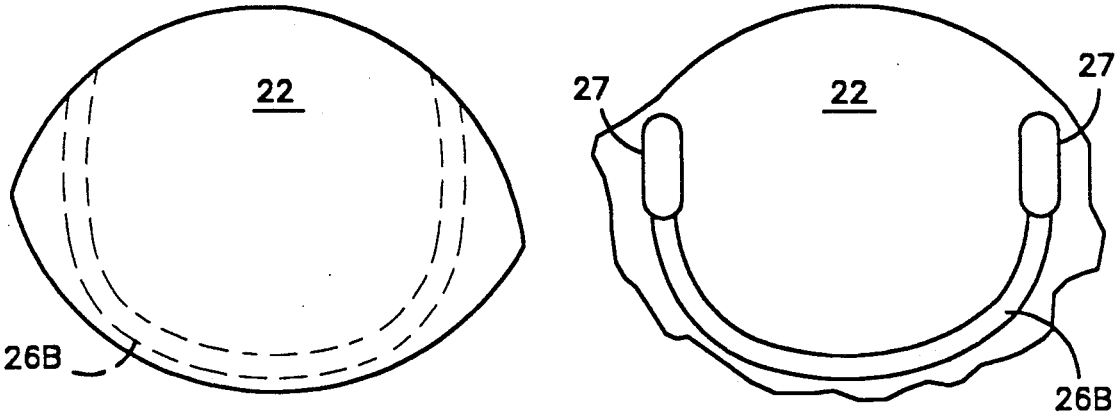

FIG. 9 illustrates reinforcement material under wire 26B joined to the interior lower portion of each cup. The two tips 27 of under wire 26B each have a plastic molded tip thereupon.

The embodiment of FIG. 10 illustrates a strapless camisole 20 having brassiere cups 22 with under wire 26B, and stretchable strip 326 suitably joined to the base and lateral length of brassiere cups 22 and which strip 32 continues and bands around the circumference of of the body of camisole 20.

Also illustrated in FIG. 10 is an adjustable neck strap 24 having one movable ring type 24A and one stationary ring type 24B indicating optional connection in the usual manner therewith.

It will thus been seen that in all embodiments of the invention (FIGS. 1, 2 and 10), a stretchable strip 32 is joined to the base of cups 22 along their length. In FIG. 1, strip 32 is joined to the camisole 20. In another embodiment FIG. 2, the cups 22 and strip 32 are removably inserted as a unit into a pocket 30A which holds them to camisole 20. In the embodiment of FIG. 10, strip 32 encircles the wearer's body and in consequence camisole 20 may be strapless, support being provided by strip 32.

OPERATION OF FIGS. 1 TO 10

The operational value of camisole 20 embodying any such practicable pair of brassiere cups 22 is the comfortable support to the wearer. In addition, there is an improved support given to the wearer by the upward and outward appearance opposed to the support given by the brassiere. The reinforcement materials 26A and 26B are optional features to the wearer for extra support but not necessarily needed. The strapless camisole 20 embodying reinforcement material under wire 26B and stretchable strip/band 32 support the camisole 20 to be worn without shoulder straps or, in the alternative, a neck strap.

The conventional adjustable straps 24 operate the adjustment feature of the camisole 20 to suite the individual wearer.

The facing 30 joined to the receiving section 28 forming a pocket 30, enables ease in the placement of brassiere cups to be suitably joined.

CONCLUSION, RAMIFICATIONS AND SCOPE OF INVENTION

Accordingly, the reader will see that the camisole combined with brassiere cups can be used to improve the appearance of the wearer; support the breasts comfortably; and can be worn in place of a plurality of undergarments.

Further, the camisole combined with brassiere cups can be manufactured easily, efficiently, and inexpensively. The facing can be joined to the interior receiving section of the camisole forming a pocket for the ease in placement of brassiere cups to be fastened. In the preferred embodiment a separate stretchable strip is affixed to the body of camisole beneath the brassiere cups. However, for wearers such as younger women not requiring as much support, an equivalent means would be to insert one or more rows of elastic stitching, or gathering stitching with elastic thread, in a manner known to those skilled in the art, in the body of the camisole.

While the above description contains many details, these should not be construed as limitations on the scope of the invention, but as merely providing illustrations of some of the presently preferred embodiments of this invention. For example, the camisole may be of any style, size, shape, color and material; the brassiere cups can be of any practicable type.

Thus the scope of the invention should be determined by the appended claims and their legal equivalents, rather than by the examples given.

What is claimed is:

1. In a camisole, the improvement comprising a breast receiving portion of said camisole and a generally elongated stretchable strip portion, said stretchable strip portion having a horizontal elongated lengthwise dimension along which it is stretchable, and being located generally only beneath breasts of a wearer, and not encircling the wearer's chest; and one or more brassiere cups, said brassiere cups being received in but separate from said breast receiving portion, said one or more brassiere cups being affixed to said stretchable strip portion, and said strip portion having no portion or member encircling the wearer's chest and functioning to bind or support the breasts.

2. The camisole of claim 1 in which said stretchable strip portion is a separate strip attached to said camisole, which separate strip is stretchable along its lengthwise dimension.

3. The camisole of claim 1 and in which said stretchable strip portion is a generally lengthwise area of elastic gathering in said camisole itself.

4. The camisole of claim 1 and further including a facing to said breast receiving portion secured in such a way to form a pocket for said brassiere cup.

5. The camisole of claim 1 and in which said brassiere cups each have a reinforcing material secured to the interior lower portion thereof.

* * * * *